US006297786B1

(12) United States Patent
Kakuta et al.

(10) Patent No.: US 6,297,786 B1
(45) Date of Patent: Oct. 2, 2001

(54) LIQUID CRYSTAL DISPLAY APPARATUS

(75) Inventors: Ryohei Kakuta; Hideaki Nagakubo; Seiji Tokita; Yoshifumi Masumoto, all of Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/115,451

(22) Filed: Jul. 14, 1998

(30) Foreign Application Priority Data

Jul. 15, 1997 (JP) ..... 9-190183

(51) Int. Cl.[7] ..... G09G 3/36

(52) U.S. Cl. ..... 345/1.1; 345/5; 345/30; 345/94; 345/98; 345/103; 345/204; 348/564

(58) Field of Search ..... 345/94, 95, 103, 345/112, 115, 118, 204, 208, 1.1; 348/564

(56) References Cited

U.S. PATENT DOCUMENTS 4,778,260 * 10/1988 Okada et al. ..... 345/97
4,816,816 * 3/1989 Usui ..... 345/103
4,845,473 * 7/1989 Matsuhashi et al. ..... 345/103
5,392,058 * 2/1995 Tagawa ..... 345/104
5,489,919 * 2/1996 Kuwata et al. ..... 345/100
5,508,716 * 4/1996 Prince et al. ..... 345/103
5,754,160 * 5/1998 Shimizu et al. ..... 345/103
5,977,943 * 11/1999 Mano et al. ..... 345/98
6,023,252 * 2/2000 Yano et al. ..... 345/1

* cited by examiner

*Primary Examiner*—Bipin Shalwala
*Assistant Examiner*—Vincent E. Kovalick
(74) *Attorney, Agent, or Firm*—Brinks Hofer Gilson & Lione

(57) ABSTRACT

The screen of a liquid crystal panel is divided into two portions. In the divided screens (upper screen and lower screen), the corresponding common electrodes (each for one divided screen) are simultaneously driven. The driving signal (common signal C1) of the upper screen and the driving signal (common signal C2) of the lower screen change in one cycle of four frame periods. More specifically, in the above-mentioned cycle, the common signal C1 changes in a pattern (1→1→1→−1), and the common signal C2 changes in a pattern (1→−1→1→1) in synchronization with each other. Accordingly, upon comparison of the common signals C1 and C2, it appears that the signal having the same waveform is applied to the common electrodes while being out of phase with each other. Thus, a difference of the drive frequency between the upper screen and the lower screen is eliminated. It is thus possible to provide an inexpensive liquid crystal apparatus, which is connected to an existing dual-scan interface, without degrading the display quality.

3 Claims, 2 Drawing Sheets

LIQUID CRYSTAL DISPLAY APPARATUS

BACKGROUND OF THE INVENTION

1. Field of the Invention

The present invention generally relates to a liquid crystal display apparatus and, more particularly, to a liquid crystal display apparatus of simple matrix type for simultaneously driving a plurality of scanning electrodes.

2. Description of Related Art

Generally, in the field of liquid crystal display apparatuses of simple matrix type, a liquid crystal display apparatus of dual scan type is known in which a liquid crystal panel screen is divided into an upper half screen and a lower half screen and a segment driver and a common driver are provided for each of these screens to drive the same independently of each other.

However, the above-mentioned dual-scan liquid crystal display apparatus requires to provide the segment driver and the common driver for each of the screens, thereby pushing up the fabrication cost.

To lower the cost, a technique has been proposed in which only one segment driver is provided to be shared by both the screens (thereby enhancing the duty ratio).

Meanwhile, the interface of the above-mentioned (high duty ratio) liquid crystal display apparatus is different from the interface used on the preceding dual-scan liquid crystal display apparatuses. Consequently, the preceding dual-scan liquid crystal display apparatus installed on a system cannot be directly replaced with the above-mentioned (high duty ratio) liquid crystal display apparatus.

Further, the above-mentioned (high duty ratio) liquid crystal display apparatus presents a problem of lowered display quality caused by decreased contrast and increased crosstalk.

In order to solve these problems, a liquid crystal display apparatus as disclosed in Japanese Published Unexamined Patent Application No. Hei 9-22275 for example has been developed. In the disclosed liquid crystal display apparatus, m types of orthogonal functions and, in each of the upper and lower screens, m/2 common electrodes are simultaneously selected, and a signal based on the orthogonal functions is applied to the selected common electrodes.

In this case, however, a difference between the drive frequency of the common electrode on the upper screen and the one on the lower screen is conspicuous, thereby lowering display quality.

SUMMARY OF THE INVENTION

It is therefore an object of the present invention to provide a liquid crystal display apparatus capable of being connected to the existing dual-scan interface and realizing cost reduction without degrading display quality.

In carrying out the invention and according to one aspect thereof, there is provided a liquid crystal display apparatus comprising: a liquid crystal panel; a common-electrode select means that divides a common-electrode group of the liquid crystal panel into two common-electrode groups each having a same number of consecutive common electrodes, sequentially selects one common electrode from one of the common-electrode groups and drives the selected common electrode by use of a first common signal having a predetermined frequency, and sequentially selects one common electrode from the other common-electrode group by use of a second common signal having the frequency of the first common signal but having a phase different from the one of the first common signal and in synchronization with the selection and driving by the first common signal; and a segment electrode select means for driving all segment electrodes every time the common-electrode select means selects one common electrode.

In the present invention, the common-electrode select means divides the common-electrode group of the liquid crystal panel into two common-electrode groups each having the same number of consecutive common electrodes, sequentially selects one common electrode from one of the common-electrode groups and drives the selected common electrode by use of the first common signal having a predetermined frequency, and sequentially selects one common electrode from the other common-electrode group by use of the second common signal having the frequency of the first common signal but having a phase different from the one of the first common signal and in synchronization with the selection and driving by the first common signal. The segment electrode select means drives all segment electrodes every time the common-electrode select means selects one common electrode.

BRIEF DESCRIPTION OF THE DRAWINGS

These and other objects of the invention will be seen by reference to the description, taken in connection with the accompanying drawing, in which.

DETAILED DESCRIPTION OF PREFERRED EMBODIMENTS

This invention will be described in further detail by way of example with reference to the accompanying drawings.

1. Overview

First, a liquid crystal display apparatus practiced as one preferred embodiment of the invention will be outlined.

The following description uses a simple-matrix liquid crystal panel having display dots of 640 in the row (lateral) direction and 480 in the column (vertical) direction for example.

For the convenience of description, 640 segments arranged in the row direction are referred to as "segment electrodes 1 through 640" and 480 common electrodes arranged in the column direction are referred to as "common electrodes 1 through 480."

In the present preferred embodiment, the screen of this liquid crystal panel is divided into two, namely "an upper screen" (640 dots×240 dots) and "a lower screen" (640 dots×240 dots).

In the present preferred embodiment, one common electrode of each of the upper and lower screens is driven (a signal at a predetermined voltage is applied to the electrode).

Namely, for one entire screen of the liquid crystal panel, a total of 2 common electrodes are simultaneously driven.

In what follows, a signal to be applied to the common electrode of the upper screen is referred to as "a common signal C1, " while a signal to be applied to the common electrode of the lower screen is referred to as "a common signal C2."

Figure 1:
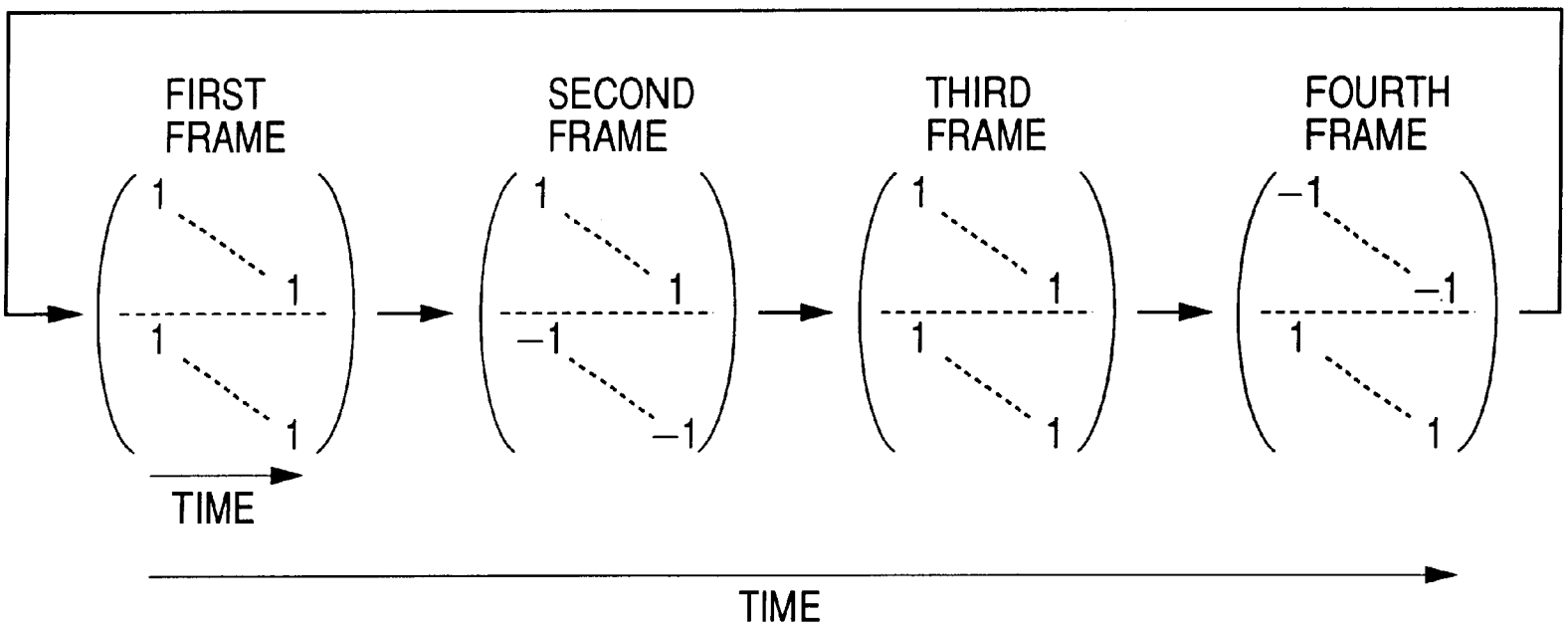
FIG. 1 is a diagram illustrating an example of signals (common signals C1 and C2) to be applied to a common electrode of a liquid crystal display apparatus practiced as one preferred embodiment of the invention.

FIG. 1 is a diagram illustrating one example of the signals (common signals C1 and C2) to be applied to the common electrodes in a liquid crystal display apparatus practiced as one preferred embodiment of the invention.

In the figure, "1" denotes a high-level signal having a predetermined potential, while "−1" denotes a low-level signal having a predetermined potential other than the predetermined potential of the high-level signal.

In the figure, each pair of parentheses denotes 1 frame (1 screen) of scan period.

In each pair of parentheses, a signal ("1" or "−1") over the dividing line (a dashed line) denotes the above-mentioned common signal C1, while a signal ("1" or "−1") below the dividing line denotes the above-mentioned common signal C2.

As shown in the figure, the common signal C1 is sequentially applied to the common electrode 1 through the common electrode 240 in each frame period as time passes (namely, these common electrodes are scanned).

Likewise, the common signal C2 is sequentially applied to the common electrode 241 through the common electrode 480 in each frame period as time passes (namely, these common electrodes are scanned).

At this moment, each of the common signals C1 and C2 change in one cycle of four frame periods. Namely, the common signal C1 changes in a pattern (1→1→1 →−1) in a unit of above-mentioned one cycle and by use of each frame switching point as a change point. On the other hand, the common signal C2 changes in a pattern (1→−1→1→1) in a unit of the above-mentioned one cycle and by use of each frame switching point as a change point.

Thus, in the present embodiment, the common signal C1 changes in the pattern (1→1→1→−1) in synchronization with the common signal C2, which changes in the pattern (1→−1→1→1).

Consequently, comparison between the common signal C1 and the common signal C2 makes these signals appear to be signals having a same waveform that are applied, only with a shifted phase, to the common electrodes.

Therefore, in the present embodiment, the difference between the drive frequency (the frequency of the common signal C1) of the upper screen and the drive frequency (the frequency of the common signal C2) of the lower screen is eliminated, thereby preventing the degradation of display quality.

2. Specific Example

The following describes a specific example for realizing the above-mentioned concept.

Figure 2:
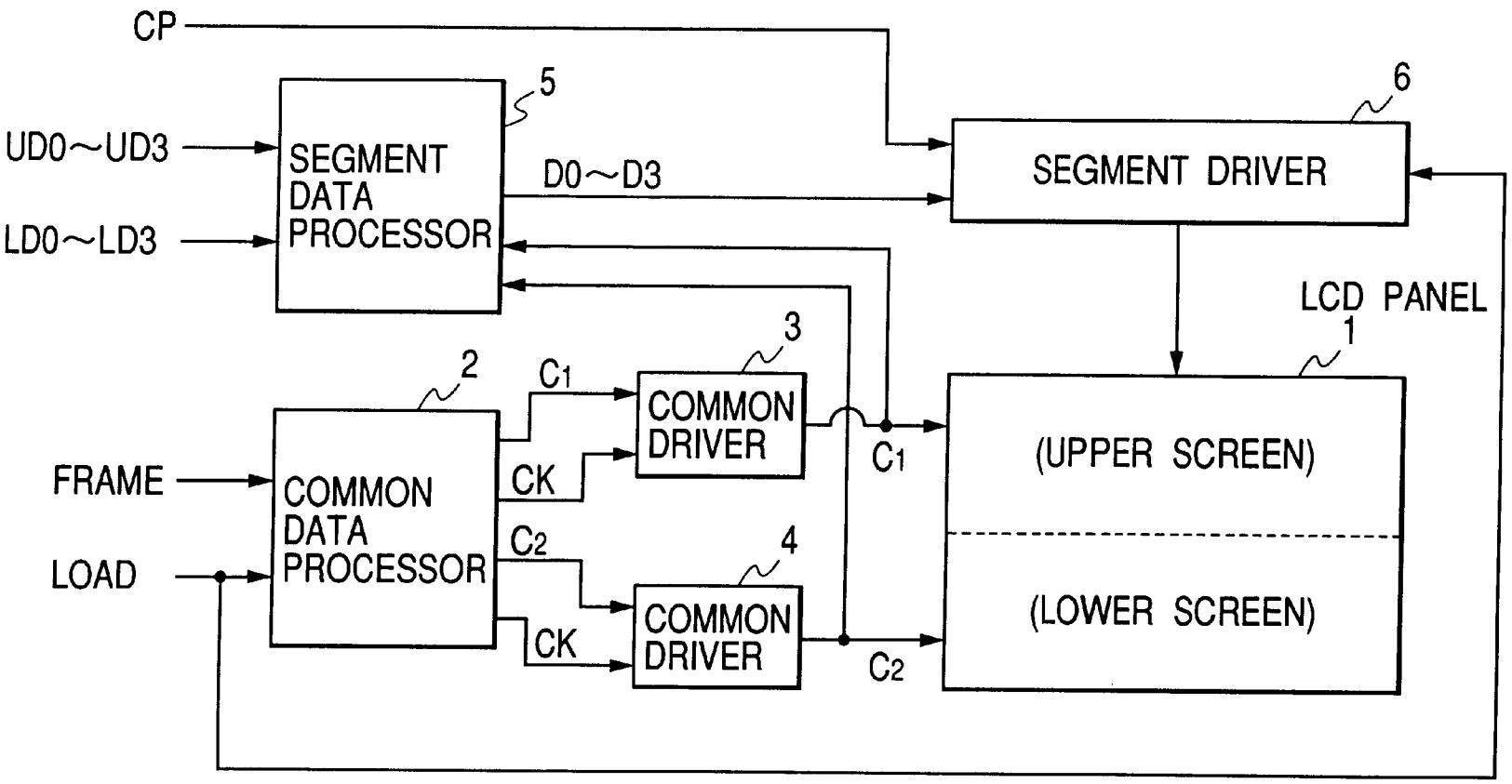
FIG. 2 is a block diagram illustrating an example of a constitution of the above-mentioned preferred embodiment.

Now, referring to FIG. 2, there is shown a block diagram illustrating an example of a constitution of the liquid crystal display apparatus practiced as one preferred embodiment of the invention.

In the figure, a liquid crystal panel 1 is a simple-matrix liquid crystal panel having 640 dots in the row (lateral) direction and 480 dots in the column (vertical) direction. Namely, the liquid crystal panel 1 has 640 segment electrodes in the row direction and 480 common electrodes in the column direction.

A common data processor 2 generates the above-mentioned common signals C1 and C2 based on frame data FRAME. The common data processor 2 also generates a clock CK for common electrode scanning based on a load signal LOAD.

A common driver 3 sequentially applies the common signal C1 to the common electrodes of the upper screen with a timing indicated by the scan clock CK.

On the other hand, a common driver 4 sequentially applies the common signal C2 to the common electrodes of the lower screen with a timing indicated by the scan clock CK.

A segment data processor 5 performs a predetermined computation on the common signals C1 and C2 consisting of normalized orthogonal functions and segment data UD0 through DU3 for the upper screen and segment data LD0 through LD3 for the lower screen Based on the result of this computation, the segment data processor 5 generates segment data D0 through D3.

A segment driver 6 sequentially reads the segment data D0 through D3 with a timing indicated by a clock pulse CP. The segment driver 6 stores the read segment data D0 through D3 into a register (not shown) incorporated in the segment driver 6. The segment driver 6 repeats this read operation 160 (=640/4) times. When the segment data becomes ready for all segment electrodes (namely, 640 electrodes), the segment driver 6 applies the 640 pieces of segment data to the segment electrodes of the liquid crystal panel 1 with a timing based on the signal LOAD.

The interface (the constitution of externally supplied signals) of the present liquid crystal display apparatus is composed of the segment data UD0 through UD3 for the upper screen, the segment data LD0 through LD3 for the lower screen, the clock pulse CP, the frame data FRAME, and the load signal LOAD.

The above-mentioned interface is compatible with the interface of standard dual-scan liquid crystal display apparatuses.

The signals constituting the above-mentioned interface are supplied from a display controller (not shown) arranged separately from the present liquid crystal display apparatus. Generally, this display controller is a controller to be designed by the designer (namely the purchaser of the present liquid crystal display apparatus) of an apparatus on which the present liquid crystal display apparatus is assembled.

The segment data UD0 through UD3 for the upper screen is signals to be applied to the segment electrodes of the upper screen in the dual-scan liquid crystal display apparatus.

On the other hand, the segment data LD0 through LD3 is signals to be applied to the electrodes of the lower screen in the dual-scan liquid crystal display apparatus.

The clock pulse CP is a clock pulse for use when the segment driver 6 reads the segment data D0 through D3.

The frame data FRAME is the source data for the above-mentioned common signals C1 and C2.

The load signal LOAD is a pulse signal of 1/240 period in one frame period.

The following describes the operation of the liquid crystal display apparatus having the above-mentioned constitution.

(1) Common-electrode Drive Processing

When the power is turned on and the display processing for the first frame starts, the display controller (not shown) inputs frame data FRAME into the common data processor 2.

Based on the frame data FRAME, the common data processor 2 generates the common signals C1 and C2.

Since the current frame is the first frame, the common signals C1 and C2 are both "1" as shown in FIG. 1.

The common data processor 2 inputs the generated common signal C1 into the common driver 3 and the generated common signal C2 into the common driver 4.

On the other hand, the above-mentioned display controller inputs the load signal LOAD into the common data processor 2. As described above, the load signal LOAD is a pulse signal of 1/24 period in one frame period.

Therefore, the common data processor 2 inputs the load signal LOAD into the common drivers 3 and 4 as the clock CK for common-electrode scanning.

Consequently, the common driver 3 sequentially switches between the common electrodes to be applied with the common signal C1 in the order of the first common electrode, the second common electrode, . . . , and 240th common electrode every time the pulse of the scanning clock CK is inputted.

Likewise, the common driver 4 sequentially switches between the common electrodes to be applied with the common signal C2 in the order of the 241st common electrode, the 242nd common electrode, . . . , and 480th common electrode every time the pulse of the scanning clock CK is inputted.

When the processing for applying the common signals C1 and C2 in the first frame has been completed (namely when the scanning clock CK has been counted by 240 pulses), the above-mentioned display controller inputs new frame data FRAME into the common data processor 2.

Based on the inputted frame data FRAME, the common data processor 2 generates new common signals C1 and C2.

Since the current frame is the second frame, the common signal C1 is "1" and the common signal C2 "−1" as shown in FIG. 1.

Subsequently, the common signals C1 and C2 are applied to the common electrodes in the same manner as with the first frame. When the application has been completed, the processing for applying the common signals C1 and C2 in the second frame comes to an end.

Subsequently, the processing for applying the common signals C1 and C2 in the third and fourth frames (refer to FIG. 1) is performed in the same manner as with the first and second frames.

At this moment, as shown in FIG. 1, the common signals C1 and C2 are both "1" in the third frame and the common signal C1 is "−1" and the common signal C2 is "1" in the fourth frame.

When the common signal application processing in the fourth frame comes to an end, the processing returns to the first frame as shown in FIG. 1.

(2) Segment-electrode Drive Processing

In a period in which the above-mentioned common signals C1 and C2 are kept applied to one common electrode (namely, a period in which one scan line is selected), the following drive processing is performed on the segment electrodes.

First, the common signal C1 outputted from the common driver 3 and the common signal C2 outputted from the common driver 4 are both inputted in the segment data processor 5.

Next, the above-mentioned display controller inputs the segment data UD0 through UD3 for the upper screen and the segment data LD0 through LD3 for the lower screen into the segment data processor 5.

Based on the common signals C1 and C2, the segment data UD0 through UD3 for the upper screen, and the segment data LD0 through LD3 for the lower screen, the segment data processor 5 generates segment data D0 through D3.

The segment driver 6 reads the generated segment data D0 through D3 with a timing indicated by the clock pulse CP.

The segment driver 6 stores the read segment data D0 through D3 into a register (not shown) incorporated in the segment driver 6.

The segment driver 6 repeats this read processing operation 160 (=640/4) times.

Consequently, when all segment electrodes of segment data (namely, 640 pieces of segment data) have become ready, the segment driver 6 applies these 640 pieces of segment data to the segment electrodes of the liquid crystal panel 1 with a timing based on the signal LOAD.

3. Supplement

While the preferred embodiment of the present invention has been described using specific terms, such description is for illustrative purposes only, and it is to be understood that changes and variations may be made without departing from the spirit or scope of the appended claims.

As described and according to the invention, the liquid crystal display apparatus can be connected directly to the existing dual-scan interface without sacrificing display quality and at reduced cost.

What is claimed is:

1. A liquid crystal display apparatus comprising:

a liquid crystal panel;

a common-electrode selector that divides a common-electrode group of said liquid crystal panel into two common-electrode groups each having a same number of consecutive common electrodes, sequentially selects one common electrode from one of the common-electrode groups and drives the selected common electrode by use of a first common signal having a predetermined frequency, and sequentially selects one common electrode from the other common-electrode group by use of a second common signal having the frequency of said first common signal but having a phase different from that of the first common signal and in synchronization with the selection and driving by said first common signal; and a segment electrode selector to drive all segment electrodes every time said common-electrode selector selects one common electrode, said segment-electrode selector having one segment driver for driving all of said segment electrodes, wherein said first common signal changes in a pattern (1→1→1→−1) in one cycle of four screens of said liquid crystal panel of scan period and at a change point which is an end point of one screen of scanning, and said second common signal changes in a pattern (1→−1→1→1) in one cycle of four screens of said liquid crystal panel of scan period and at the change point which is the end point of one screen of scanning.

2. The liquid crystal display apparatus as claimed in claim 1, wherein, in said liquid crystal panel, the segment electrodes cross all common electrodes.

3. The liquid crystal display apparatus as claimed in claim 1, wherein said segment selector has a segment data processor to generate a drive signal for driving the segment electrodes based on upper-screen segment data and lower-screen segment data, which are a dual-scan interface signal, and said common-electrode selector has a common data processor to generate said first common signal and said second common signal based on frame data, which is a dual-scan interface signal.

* * * * *